US012035792B2

(12) United States Patent
Lelieveld

(10) Patent No.: US 12,035,792 B2
(45) Date of Patent: Jul. 16, 2024

(54) HAIR STRAIGHTENER

(71) Applicant: KONINKLIJKE PHILIPS N.V., Eindhoven (NL)

(72) Inventor: Mark Lelieveld, Shatin (HK)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 323 days.

(21) Appl. No.: 17/285,928

(22) PCT Filed: Dec. 6, 2019

(86) PCT No.: PCT/EP2019/084020
§ 371 (c)(1),
(2) Date: Apr. 16, 2021

(87) PCT Pub. No.: WO2020/115294
PCT Pub. Date: Jun. 11, 2020

(65) Prior Publication Data

US 2021/0386171 A1 Dec. 16, 2021

(30) Foreign Application Priority Data

Dec. 7, 2018 (CN) ..... 201822052995.2
Mar. 28, 2019 (EP) ..... 19165702

(51) Int. Cl.
*A45D 2/00* (2006.01)

(52) U.S. Cl.
CPC ..... *A45D 2/001* (2013.01); *A45D 2200/15* (2013.01)

(58) Field of Classification Search
CPC ... A45D 1/00; A45D 1/04; A45D 1/06; A45D 1/08; A45D 1/10; A45D 1/12; A45D 1/14;
(Continued)

(56) References Cited

U.S. PATENT DOCUMENTS 6,627,852 B1 9/2003 Savone
2010/0083978 A1* 4/2010 Hottenrott ..... A45D 1/06 132/211

(Continued)

FOREIGN PATENT DOCUMENTS

CN 204363211 6/2015
CN 206295033 7/2017

(Continued)

OTHER PUBLICATIONS

EP2641501A1 Hairdressing appliance with jaws. Original and Translation (Year: 2013).*

(Continued)

*Primary Examiner* — Cris L. Rodriguez
*Assistant Examiner* — Karim Asqiriba

(57) ABSTRACT

In a hair straightener comprising an elongate straightener arm (A) having a heating plate (H), the invention provides a pivot mechanism (2) for supporting the heating plate (H) in a pivotable manner around a pivot axis (P1) in a longitudinal direction of the elongate straightener arm (A). Preferably, the pivot axis (P1) is at a heating surface of the heating plate (H), or between a first heating plate of a first straightener arm and a second heating plate of a second straightener arm when the first straightener arm and the second straightener arm are in a relative position arranged for clamping hair. Advantageously, a bias mechanism (4) (e.g. a resilient member like some spring) biases the heating plate (H) to a neutral position.

20 Claims, 4 Drawing Sheets

(58) Field of Classification Search
CPC ..... A45D 1/28; A45D 2200/15; A45D 7/02; A45D 2/001; A45D 20/00; A45D 20/124; A45D 26/0023; A45D 26/0028; A45D 26/0042
See application file for complete search history.

(56) References Cited

U.S. PATENT DOCUMENTS

| | | | | |
|---|---|---|---|---|
| 2010/0147323 | A1 | 6/2010 | Hafemann | |
| 2014/0261524 | A1* | 9/2014 | Smith | A45D 1/04 132/211 |
| 2015/0136169 | A1* | 5/2015 | Moore | B21J 5/02 29/846 |
| 2016/0120283 | A1 | 5/2016 | Yu | |
| 2016/0255936 | A1* | 9/2016 | deGrood | A45D 1/04 |
| 2016/0271815 | A1* | 9/2016 | Molema | B26B 19/042 |
| 2017/0231350 | A1* | 8/2017 | Moore | A45D 2/001 132/224 |
| 2018/0020795 | A1* | 1/2018 | Keong | A45D 7/02 132/211 |
| 2019/0045901 | A1* | 2/2019 | Kock | A45D 1/08 |

FOREIGN PATENT DOCUMENTS

| | | | | |
|---|---|---|---|---|
| DE | 202008001677 | | 6/2009 | |
| EP | 2641501 | A1 * | 9/2013 | A45D 1/06 |
| JP | S62127201 | U | 8/1987 | |
| JP | 2014217748 | | 11/2014 | |

OTHER PUBLICATIONS

International Search Report and Written Opinion Dated Jan. 7, 2020 for International Application No. PCT/EP2019/084020 Filed Dec. 6, 2019.

International Preliminary Report on Patentability Dated Mar. 23, 2020 for International Application No. PCT/EP2019/084020 Filed Dec. 6, 2019.

* cited by examiner

HAIR STRAIGHTENER

CROSS REFERENCE TO RELATED APPLICATIONS

This application is the U.S. National Phase application under 35 U.S.C. § 371 of International Application No. PCT/EP2019/084020 filed Dec. 6, 2019, which claims the benefit of European Patent Application Number 19165702.2 filed Mar. 28, 2019 and Chinese Patent Application Number 201822052995.2 filed Dec. 7, 2018. These applications are hereby incorporated by reference herein.

FIELD OF THE INVENTION

The invention relates to a hair straightener.

BACKGROUND OF THE INVENTION

U.S. 2015136169 discloses a hair styling apparatus comprises a first and a second arm each comprising a heatable plate and arm member. The first and second arms are moveable between a closed position in which the heatable plate of the first arm is adjacent the heatable plate of the second arm and an open position in which the heatable plates of each arm are spaced apart. The heatable plate of at least one of the arms is coupled to a respective arm member about a pivot arranged to allow the heatable plate to move relative to the respective arm member about an axis transverse to the length of said respective arm member such that the plate pivots.

JP2014217748 discloses a hair iron capable comprising a heating member that sandwiches the hair between a pair of arms that can be opened and closed. A first heating surface is formed in an oblique shape of 30° to 80° with respect to the opening/closing direction of the arm. A holding member holds the heating members in an inclined position.

U.S. 2010/083978 A1 discloses a hair-styling device having an essentially cylindrical heating part on which at least one heatable styling part is provided for heating hair. A guide means is arranged around the styling part. The heatable styling parts and the guide means can be rotated with respect to each other.

SUMMARY OF THE INVENTION

It is, inter alia, an object of the invention to provide an improved hair straightener. The invention is defined by the independent claim. Advantageous embodiments are defined in the dependent claims.

One aspect of the invention provides a hair straightener comprising an elongate straightener arm having a heating plate, in which a pivot mechanism supports the heating plate in a pivotable manner around a pivot axis in a longitudinal direction of the elongate straightener arm. Preferably, the pivot axis is at a heating surface of the heating plate, or between a first heating plate of a first straightener arm and a second heating plate of a second straightener arm when the first straightener arm and the second straightener arm are in a relative position arranged for clamping hair. Advantageously, a bias mechanism (e.g. a resilient member like some spring) biases the heating plate to a neutral position.

Various embodiments of the invention are based on the following considerations. Hair straighteners are used to straighten hair. They mainly consist out of two arms with on each end a heating plate. Most of those plates are suspended via rubbers to allow them to flex when hair is in between.

This flexing helps against pulling and better distribution of heat and reduce drag/stick slip a bit. However, the system is force balanced via rubbers so the plates not optimal follow the hair and can cause inefficiencies. Advantageous embodiments provide a virtual pivot point in the hair level, and freely adjustable plates that automatically follow the hair shapes/curves and adjust to forces. This will result in better heat transfer, and better and more controlled gliding.

These and other aspects of the invention will be apparent from and elucidated with reference to the embodiments described hereinafter.

BRIEF DESCRIPTION OF THE DRAWINGS

Throughout the drawings, the same or similar reference symbols are used to indicate the same or similar elements.

DESCRIPTION OF EMBODIMENTS

Figure 1A:
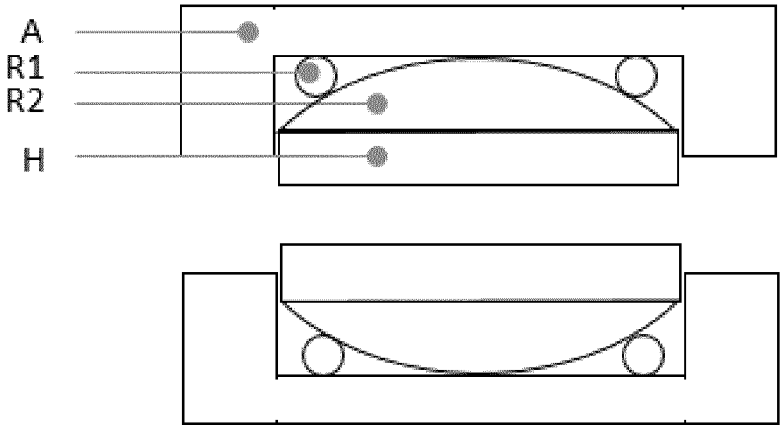
FIGS. 1A and 1B illustrate an embodiment of a hair straightener in accordance with the present invention.
Figure 1B:
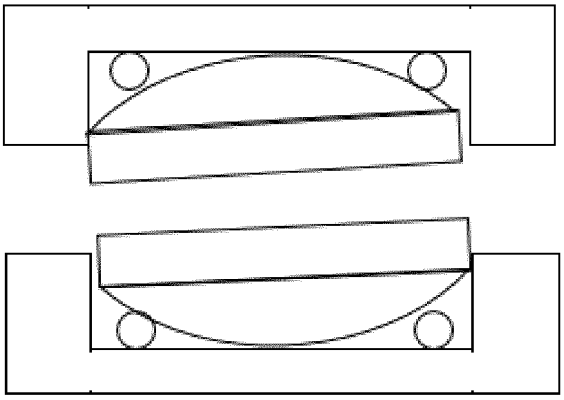
Figure 2:
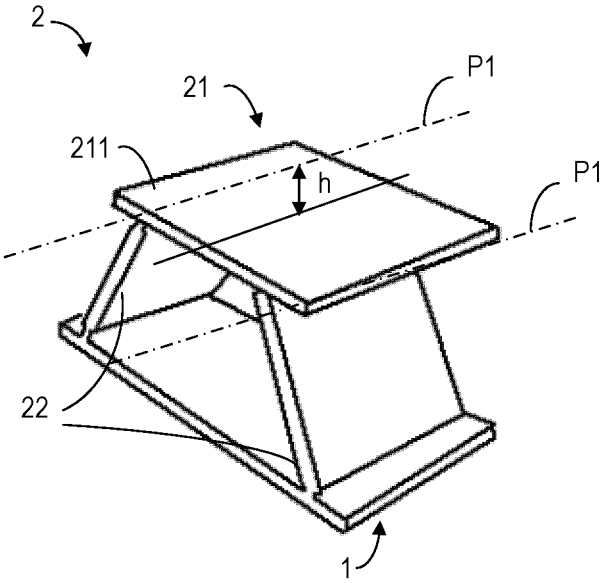
FIG. 2 illustrates a detailed view of a pivot mechanism, in accordance with an embodiment of the present invention.

FIGS. 1A, 1B show a cross-section of a pair of elongate hair straightener arms A. A longitudinal direction of the straightener arms A is perpendicular to the 2-dimensional cross-section of FIGS. 1A, 1B. In the embodiment of FIGS. 1A and 1B, in a hair straightener arm A, a pivot mechanism is formed by rolling members R1, R2. The pivot mechanism is between a body of the arm A and a heating plate H. The rolling members R1 allow tilting of the rolling member R2 on which a heating plate H is mounted. FIG. 1 shows the heating plates H in a neutral position, while FIG. 2 shows the heating plates H in a tilted position. By allowing the heating plates H to tilt, they can follow the hair so that the hair is not subjected to an undesired bending.

Figure 5A:
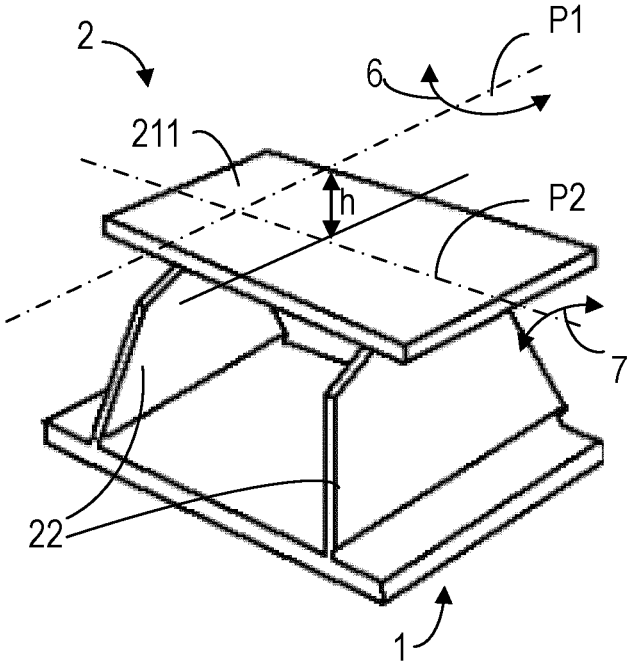
FIG. 5A illustrates a detailed view of a pivot mechanism, in accordance with another embodiment of the present invention.

FIG. 2 illustrates a detailed view of another pivot mechanism 2 for use in a hair straightener according to the present invention. The pivot mechanism 2 defines a virtual, first pivot axis P1 which is parallel to the surface to which the heating plate H is attached. During the operation, the virtual pivot axis P1 is automatically moved along a defined path in response to the motion of the pivot mechanism 2. In FIG. 5A, the motion of the pivot mechanism 2 is schematically illustrated by the arrow 6. In various embodiments of the present disclosure, a pivot mechanism 2 comprises a top portion 21 coupled to the heating plate H (for sake of clarity, heating plate H is not shown in FIG. 2) and a support portion 22 coupled to the base portion 1. The top portion 21 and the support portion 22 are movable with respect to each other, such that the heating plate H is pivotably supported by the pivot mechanism 2 during operation.

As further illustrated in FIG. 2, a first pivot axis P1 for the top portion 21 defined by the pivot mechanism 2 is parallel to a surface 211 defined by the top portion 21. During the operation, the first pivot axis P1 is located either substantially in the surface 211 of the top portion 21, or above the surface 211 on a side opposite to the base portion 1 by a defined height h.

As used herein, the virtual pivot axis may be regarded as an instantaneous rotation axis of the mounted heating plate H that is defined by the pivot mechanism 2. During operation, the heating plate H may be pivotable with respect to the body 1 of the hair appliance. When in use, the virtual pivot axis P1 may be located on the hair surface or in the hair. Consequently, the pivoting response capability of the pivot mechanism 2 when being guided through the hair for styling, can be adjusted accordingly. In this way, the hair following capability of the heating plate H may be improved.

Figure 3A:
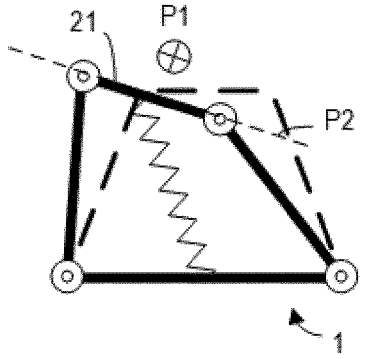
FIGS. 3A-3C illustrate the motion of a pivot mechanism as shown in FIG. 2.
Figure 3B:
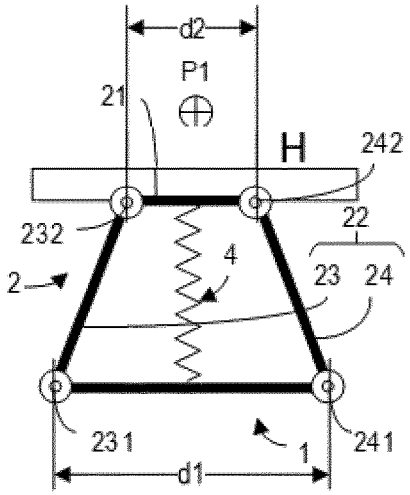
Figure 3C:
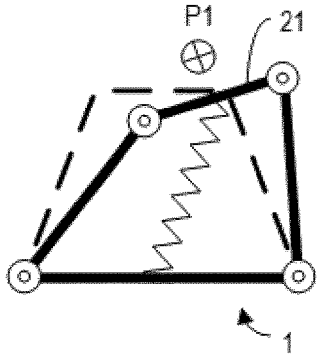

FIGS. 3A-3C illustrate the motion of the pivot mechanism 2 as shown in FIG. 2. As shown, the pivot mechanism 2 is switchable between a first position and a second position. In the first position, the surface of the top portion 21 is angled with respect to a surface of the base portion 1 by a first degree. In the second position, the surface of the top portion 21 is angled with respect to the surface of the base portion 1 by a second degree that is different from the first degree.

In the example as shown in FIGS. 3A-3C, the first position can be the neutral position (FIG. 3B), and the second positions can be the swivel position (FIGS. 3A and 3C). When the pivot mechanism 2 is located in the neutral position, the angle between the surface of the top portion 21 and a surface of the base portion is zero, that is, the two surfaces are parallel with each other. When the pivot mechanism 2 is in the swivel position, the surface of the top portion and a surface of the base portion form a non-zero angle. In other words, during the pivot movement, the heating plate H may be moved back and forth continuously within a given angular range. Again, for the sake of clarity, the heating plate H is only shown in FIG. 3B.

This may be beneficial, since the hair following capability of the heating plate H can be further improved in this way. When moved over the hair, the heating plate H may be regarded as a lever that is associated with a respective fulcrum defined by the virtual pivot axis P1. This may be even further beneficial in cases as illustrated in FIGS. 3A-3C where the virtual pivot P1 is arranged in a center portion, or middle portion, of the heating plate H.

Still referring to FIGS. 3A-3C, in some embodiments, the hair appliance may further comprise a resilient member 4 coupled to the pivot mechanism 2. The resilient member 4 is configured to provide a resistance force to the pivot mechanism 2 when the pivot mechanism 2 is switched from the first position to the second position. On the other hand, the resilient member 4 is further configured to restore the pivot mechanism 2 from the second position to the first position. Through adding the resilient member 4 to the pivot mechanism 2, a smoother and more balanced operation of the pivot mechanism 2 can be ensured.

For example, in some embodiments, the resilient member 4 may be a spring having a constant spring constant, or a spring having a constant torque. Adding a spring with a constant spring constant will result in a bigger force when the pivot mechanism 2 rotated further away from neutral position. On the other hand, a constant torque spring will keep the force constant.

In the example embodiment as shown in FIGS. 3A-3C, a spring having a constant spring constant is adopted. In this example, one end of the spring is coupled to the top portion 21 of the pivot mechanism 2 and the other end of the spring is coupled to the base portion 1. It is to be understood that the force applied by the spring can be made variable, either manually or electrically, by changing the pretension of the spring by elongating or shortening it.

The resilient element 4 may be defined or selected, such that the restoring force is small enough to be easily overcome during operation of the styling operation, when the heating plate H is guided along the hair, for instance at a basically curved neck area. Consequently, the heating plate H may be basically self-aligning with respect to the hair surface and, furthermore, self-restoring, just after an external load or force has been released.

Still referring to FIGS. 3A-3C, in some embodiments, the pivot mechanism 2 is arranged as a three-bar linkage mechanism, having a trapezoid shape. As shown, the three-bar linkage pivot mechanism comprises a first bar 23 and a second bar 24 arranged opposite to the first bar 23, and both of them are configured as the support portion 22 of the pivot mechanism 2. Further, the three-bar linkage pivot mechanism also comprises a top bar (also referred to as a "connecting bar") coupling to the first bar 23 and the second bar 24 and configured as the top portion 21 of the pivot mechanism 2.

As further illustrated in FIGS. 3A-3C, the first bar 23 comprises a first base pivot 231 coupled to the base portion 1 and a first top pivot 232 coupled to the top bar. Further, the second bar 24 comprises a second base pivot 241 coupled to the base portion 1 and a second top pivot 242 coupled to the top bar. The first base pivot 231 and the second base pivot 241 are arranged at the base portion 1 and separated by a predefined distance d1.

Since it is generally desired to reduce the size and the mass of the hair appliance and particularly of the heating plate H, there exist practical design limits for positioning a pivot for the heating plate H. This is because the installation space for implementing a single-axis linkage unit, or a circular joint, a knee joint for the heating plate H (normally the axis or the joint is located at the opposite side of the heating plate H from the hair) might be limited conventionally. Also, a possible range of the area where the pivot axis can be placed might be limited. Consequently, the mounting of such a conventional heating plate H may be regarded as adversely affecting the hair following capability of the heating plate H since a considerably poor swiveling behavior may occur.

It has been observed that the three-bar linkage mechanism can be designed in a suitable manner, so that a virtual pivot axis P1 that may also be regarded as a moving (or floating) virtual pivot can be defined. As illustrated in FIGS. 3A-3C, during the pivot movement of the heating plate H back and forth, the three-bar linkage mechanism may be designed such that the virtual pivot is (virtually) arranged. The virtual pivot axis P1 is located at a defined distance from the top portion 21 that cannot be achieved with conventional single-pivot coupling mechanisms, given the installation available space. In some cases, the resulting virtual pivot may even be arranged at a portion of the hair appliance that is basically obstructed by further components thereof, for example, in the middle of the heating plate H.

In some embodiments as shown in FIGS. 3A-3C, the length of the base portion 1 defined by a distance d1 between the first base pivot 231 and the second base pivot 241 is greater than the length of the top portion 21 defined by a distance d2 between the first top pivot 232 and the second top pivot 242. In this way, the virtual pivot axis P1 may be shifted upwards in the first position and above the level of the top portion 21 or, in other words, into the hair.

Figure 4A:
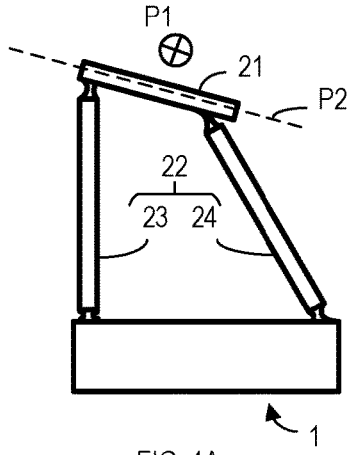
FIGS. 4A-4C illustrate the motion of a pivot mechanism according to another embodiment of the present invention.
Figure 4B:
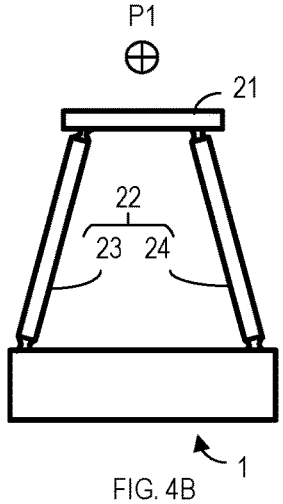
Figure 4C:
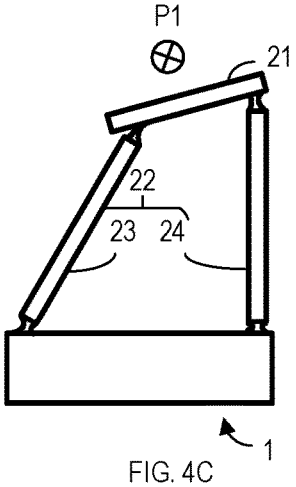

In some embodiments, at least one of the first base pivot 231, the second base pivot 241, the first top pivot 232, and the second top pivot 242 is configured as a living hinge, and particularly a film hinge. FIGS. 4A-4C illustrate an embodiment of pivot mechanism 2 of the present disclosure. In this example, all of the first base pivot 231, the second base pivot 241, the first top pivot 232, and the second top pivot 242 are configured as film hinges.

Film hinges or thin-film hinges may be manufactured, for instance, via an injection molding process. Consequently, at least one of the pivots and the respective neighboring parts connected by the pivot can be produced from basically the same material in an integral manner. This arrangement may further ensure that substantially no (mechanical) play is present in the pivots. Mechanical joints that are composed of separate components are typically designed in a clearance-fit manner including a defined play so as to allow a smooth pivoting motion. Moreover, film hinges may further have the advantage that any (internal) pollution of the joints can be prevented. According to another embodiment, at least the first bar, the second bar and the top bar of the three-bar linkage mechanism and their respective base pivots and top pivots are integrally formed as a single piece.

Figure 5B:
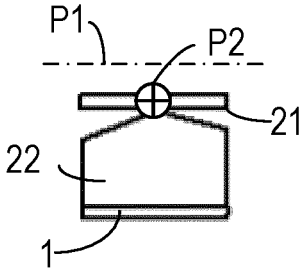
FIG. 5B illustrates a side view of a pivot mechanism as shown in FIG. 5A.

FIGS. 5A-5B illustrate another embodiment of the present disclosure. In this example, the pivot mechanism 2 further comprises a second pivot axis P2 for the top portion 21. The second pivot axis P2 is arranged substantially perpendicularly to the first pivot axis P1. In this way, besides the virtual, first axis P1 which enables a pivot movement of the heating plate H in a two-dimensional (2D) degree of freedom (DoF) (as illustrated by the arrow 6), the additional actual axis P2 along the direction perpendicular to the virtual, first axis P1 can be provided to enable the pivot movement in a third dimension (as illustrated by the arrow 7), and thereby achieving a three-dimensional (3D) DoF. In other words, when observed along the second pivot axis P2, the second pivot may be regarded as a rocking point (FIG. 5B).

Figure 6A:
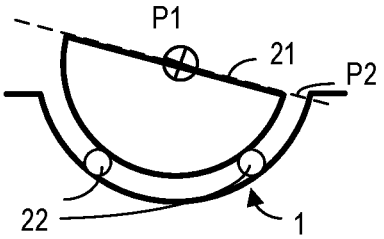
FIGS. 6A-6C illustrate the motion of a pivot mechanism according to yet another embodiment of the present invention.
Figure 6B:
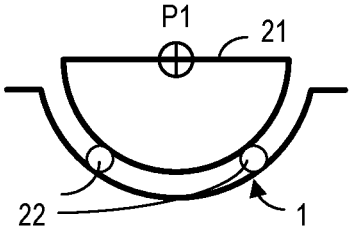
Figure 6C:
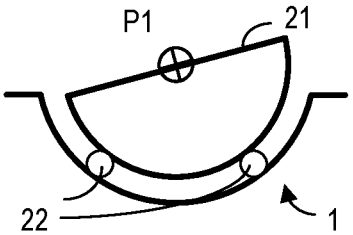

FIGS. 6A-6C illustrate another embodiment of pivot mechanism 2 of the present disclosure. In this example, the pivot mechanism 2 is arranged as a bearing mechanism comprising a rotor 21 and optional rolling members 22 (such as, roller or wheel) arranged between the rotor 21 and the base portion 1 to pivotably support the rotor 21. In this embodiment, the rotor is configured as the top portion 21, and the rolling member is configured as the support portion 22.

This type of pivot mechanism 2 might be beneficial, since the pivot mechanism 2 may have further reduced size, since the rolling member usually only consume small space, which will further improve the compactness of the hair appliance. However, instead of using the rolling members 22, the pivot mechanism 2 may be implemented as a sliding bearing.

Figure 7:
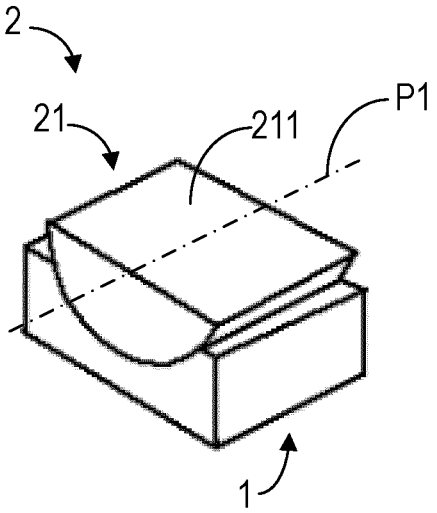
FIG. 7 illustrates a pivot mechanism according to an embodiment of the present invention.

FIG. 7 schematically illustrates an embodiment of the pivot mechanism 2 as shown in FIG. 6. In this example, the top portion 21 (that is, the rotor) is configured as a partial cylinder, and the partial cylinder comprises a rectangular cross section defining the surface 211 of the top portion 21. Here, the rollers 22 as shown in FIG. 6 are omitted.

In this case, due to the geometry of the partial cylinder, the virtual axis P1 is either above or in the surface 211 of the top portion 21, while its location is not changed (or floating). As illustrated in the example of FIG. 7, the partial cylinder has a semi-circular end surface, which corresponds to a 180° arc. In this case, as shown in FIG. 7, the virtual axis P1 is located in the surface 211 of the top portion 21. In other words, the virtual axis P1 can also be regarded the central axis of the cylinder from which the partial cylinder is obtained. In another embodiment, when the partial cylinder has a minor semi-circular end surface (that is, corresponding to an arc of less than 180°), the virtual axis is located above the surface of the top portion.

Figure 8:
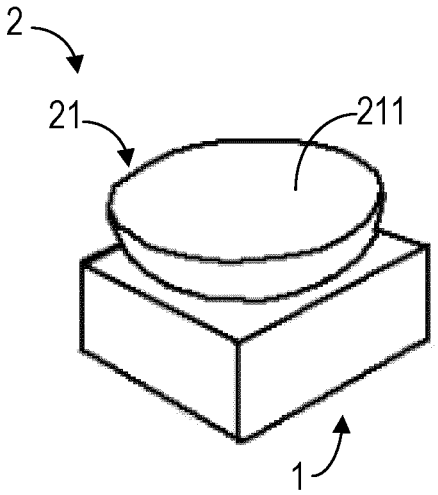
FIG. 8 illustrates a pivot mechanism according to another embodiment of the present invention.

FIG. 8 illustrates another embodiment of pivot mechanism 2 as shown in FIG. 6. In this example, the top portion 21 (that is, the rotor) is configured as a partial sphere, and the partial sphere comprises a circular cross section defining the surface 211 of the top portion 21. Compared to the partial cylinder rotor as shown in FIG. 7, the partial spherical rotor may provide a 3D pivot movement, which further improves the flexibility of the hair following during the combing operation.

In some embodiments, the hair appliance may further comprise a sensor configured to detect an angle between the top portion 21 and hair during the operation. Accordingly, the pivot mechanism 2 can be configured to pivot, for example, under the control of an actuator, to "actively" decrease the angle in response to detecting the angle beyond a threshold angle.

This might be beneficial, because it provides a proactive pivoting mechanism. In other words, the pivot mechanism 2 might start pivoting at an early stage, when the actual angle is deviated from the optimized one only by a small value. In this way, it provides a pivoting mechanism in a more accurate manner. Moreover, such proactive pivoting mechanism may further improve the comfort, because the pivot mechanism 2 would start pivoting earlier, instead of waiting until the top portion 21 receives a certain amount of external force originated from the interaction between the heating plates H and the hair.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention may be implemented by means of hardware comprising several distinct elements. In the device claim enumerating several means, several of these means may be embodied by one and the same item of hardware. Measures recited in mutually different dependent claims may advantageously be used in combination.

The invention claimed is:

1. A hair straightener for straightening hair, the hair straightener comprising:

an elongate straightener arm having a heating plate and a pivot mechanism for supporting the heating plate in a pivotable manner around a pivot axis in a longitudinal direction of the first straightener arm, wherein the pivot mechanism comprises a top portion coupled to the first heating plate and a support portion between the top portion and a body of the first straightener arm, wherein the support portion is coupled to the top portion by a plurality of top pivots such that the top portion and the support portion are movable with respect to each other, and wherein the support portion is coupled to the body of the first straightener arm by a plurality of base pivots, and a second straightener arm having a second heating plate, wherein at least the first heating plate is freely adjustable relative to the second heating plate such that at least the first heating plate automatically follows shapes and/or curves of the hair and adjust to forces, and wherein the pivot axis is at a heating surface of the first heating plate, or between the first heating plate of the first straightener arm and the second heating plate of the second straightener arm when the first straightener arm and the second straightener arm are in a relative position arranged for clamping hair.

2. The hair straightener as claimed in claim 1, further comprising a bias mechanism for biasing the first heating plate to a neutral position relative to the body of the first straightener arm.

3. The hair straightener as claimed in claim 2, wherein the bias mechanism comprises a resilient member coupled to the pivot mechanism and is configured to provide a resistance force to the pivot mechanism when the pivot mechanism is switched from the neutral position to an angled position, and to restore the pivot mechanism from the angled position to the neutral position.

4. The hair straightener as claimed in claim 1, wherein:

the support portion comprises a first bar and a second bar arranged opposite to the first bar, the first bar comprises a first base pivot of the plurality of base pivots coupled to the body of the first straightener arm, and a first top pivot of the plurality of top pivots coupled to the top portion, the second bar comprises a second base pivot of the plurality of base pivots coupled to the body of the first straightener arm, and a second top pivot of the plurality of top pivots coupled to the top portion, and the first base pivot and the second base pivot are separated by a base distance exceeding a top distance between the first top pivot and the second top pivot.

5. The hair straightener as claimed in claim 1, wherein:

the top portion comprises a rotor supporting the first heating plate, and the support portion comprises at least one member arranged between the rotor and the body of the first straightener arm to pivotably support the rotor.

6. The hair straightener as claimed in claim 5, wherein the rotor is configured as a partial cylinder or sphere having a top surface supporting the first heating plate.

7. The hair straightener as claimed in claim 1, wherein the pivot axis moves along a defined path in response to motion of the pivot mechanism.

8. The hair straightener as claimed in claim 1, wherein the bias mechanism comprises a spring having a constant spring constant or a constant torque.

9. A hair straightener for straightening hair, the hair straightener comprising:

an elongate first straightener arm having a first heating plate and a pivot mechanism for supporting the first heating plate in a pivotable manner around a pivot axis in a longitudinal direction of the first straightener arm, wherein the pivot mechanism comprises a top portion coupled to the first heating plate and a support portion between the top portion and a body of the first straightener arm, wherein the top portion and the support portion are movable with respect to each other;

a second straightener arm having a second heating plate; and a bias mechanism configured to bias the first heating plate to a neutral position, wherein the first and second heating plates are freely adjustable such that the first and second heating plates automatically follow shapes and/or curves of the hair and adjust to forces, wherein the pivot axis is at a heating surface of the first heating plate, or between the first heating plate of the first straightener arm and the second heating plate of the second straightener arm when the first straightener arm and the second straightener arm are in a relative position arranged for clamping hair, and wherein the bias mechanism comprises a resilient member coupled to the pivot mechanism and is configured to provide a resistance force to the mechanism when the pivot mechanism is switched from the neutral position to an angled position, and to restore the pivot mechanism from the angled position to the neutral position.

10. The hair straightener as claimed in claim 9, wherein:

the support portion comprises a first bar and a second bar arranged opposite to the first bar, the first bar comprises a first base pivot coupled to the body of the first straightener arm, and a first top pivot coupled to the top portion, the second bar comprises a second base pivot coupled to the body of the first straightener arm, and a second top pivot coupled to the top portion, and the first base pivot and the second base pivot are separated by a base distance exceeding a top distance between the first top pivot and the second top pivot.

11. The hair straightener as claimed in claim 9, wherein the pivot axis moves along a defined path in response to motion of the pivot mechanism.

12. The hair straightener as claimed in claim 9, wherein the resilient member comprises a spring having a constant spring constant.

13. The hair straightener as claimed in claim 9, wherein the resilient member comprises a spring having a constant torque.

14. A hair straightener for straightening hair, the hair straightener comprising:

an elongate first straightener arm having a first heating plate and a pivot mechanism configured to support the first head plate in a pivotable manner around a pivot axis in a longitudinal direction of the first straightener arm; and an elongate second straightener arm having a second heating plate, wherein the pivot mechanism comprises a top portion coupled to the first heating plate, and a support portion coupled between the top portion and a body of the first straightener arm, wherein the support portion comprises:

a first bar pivotably coupled directly to the top portion by a first top pivot and pivotably coupled to the body of the first straightener arm by a first base pivot; and a second bar, arranged opposite the first bar, pivotably coupled directly to the top portion by a second top pivot and pivotably coupled to the body of the first straightener arm by a second base pivot; and wherein the pivot axis is at a heating surface of the first heating plate, or between the first heating plate of the straightener arm and the second heating plate of the second straightener arm when the first and second straightener arms are in a relative position arranged for clamping hair between the first and second heating plates.

15. The hair straightener as claimed in claim 14, wherein the first base pivot is separated from the second base pivot by a base distance and the first top pivot is separated from the second to pivot by a top distance, wherein the base distance is greater than the top distance, such that the pivot mechanism has a trapezoid shape.

16. The hair straightener as claimed in claim 14, wherein the pivot axis moves along a defined path in response to motion of the pivot mechanism.

17. The hair straightener as claimed in claim 14, wherein each of the first top pivot, the second top pivot, the first base pivot and the second base pivot is a film hinge or a thin-film hinge.

18. The hair straightener as claimed in claim 14, further comprising a spring configured to bias the first heating plate to a neutral position relative to the body of the first straightener arm.

19. The hair straightener as claimed in claim 18, wherein the spring extends between the top portion of the pivot mechanism and the body of the first straightener arm.

20. The hair straightener as claimed in claim 18, wherein the spring has a constant spring constant or a constant torque.

* * * * *